United States Patent [19]

Urschitz

[11] Patent Number: 4,812,081

[45] Date of Patent: Mar. 14, 1989

[54] MOVABLE CONSOLIDATING TRESTLE FOR SECURING THE EXCAVATING EDGE

[75] Inventor: Ernst Urschitz, Amstetten, Austria

[73] Assignee: Voest-Alpine Aktiengesellschaft, Muldenstrasse, Austria

[21] Appl. No.: 69,605

[22] Filed: Jun. 30, 1987

[30] Foreign Application Priority Data

Jul. 2, 1986 [AT] Austria ..... 1791/86

[51] Int. Cl.[4] ..... E21D 15/44

[52] U.S. Cl. ..... 405/296; 405/291

[58] Field of Search ..... 405/291–299; 299/31–33

[56] References Cited

U.S. PATENT DOCUMENTS

| | | | |
|---|---|---|---|
| 3,570,255 | 3/1971 | Shuttleworth | 405/293 |
| 3,618,325 | 11/1971 | Kuhn et al. | 405/296 |
| 3,672,174 | 6/1972 | Von Hippel | 405/295 |
| 4,045,087 | 8/1977 | Peake | 405/296 |
| 4,065,929 | 1/1978 | Simpson | 405/293 X |
| 4,266,892 | 5/1981 | Maykemper | 405/293 |
| 4,474,510 | 10/1984 | Büll | 405/292 X |

FOREIGN PATENT DOCUMENTS

| | | | |
|---|---|---|---|
| 368604 | 10/1982 | Austria . | |
| 1092412 | 11/1960 | Fed. Rep. of Germany | 405/298 |
| 2124244 | 11/1972 | Fed. Rep. of Germany . | |
| 2503765 | 4/1976 | Fed. Rep. of Germany . | |
| 2827431 | 1/1980 | Fed. Rep. of Germany . | |
| 3303264 | 4/1984 | Fed. Rep. of Germany . | |
| 1472512 | 5/1977 | United Kingdom . | |

*Primary Examiner*—Dennis L. Taylor

*Attorney, Agent, or Firm*—Cushman, Darby & Cushman

[57] ABSTRACT

The movable consolidating trestle (2) has driven caterpillars (1). The consolidating trestle comprises a cap (3) being supported on the frame (11) via props (5). The cap (3) has at least one front-side section which is bent, rounded or bendable in direction to the frame. A bent section (8) includes with the plane of the cap (3) an angle ($\alpha$) which is greater than the maximum angle ($\beta$) of inclination with which the cap can be obliquely adjusted relative to the frame (11). When giving the cap (3) an inclined position, there results a horizontal component of the load-exerting force (14), said horizontal component facilitating saving of the consolidating trestle.

9 Claims, 2 Drawing Sheets

MOVABLE CONSOLIDATING TRESTLE FOR SECURING THE EXCAVATING EDGE

BACKGROUND OF THE INVENTION

1. Field of the Invention

The invention refers to a movable consolidating trestle for securing an excavating edge, comprising an endless tread drive and at least four props on a frame, to which is connected at least one cap.

2. Description of the Prior Art

It is of particular importance to secure the excavating edge and this in particular in case of board-and-pillar work. During such a consolidating procedure it is possible that the roof collapses after relieving the roof, and for this reason excavation work must be performed such that the various equipment can be moved into zones being secure and free of material falling in. When removing consolidating trestles for securing the excavating edge, it may sometimes occur that the consolidating trestle is buried under collapsing material and can not easily be saved. In such cases, the consolidating trestle is cleared at its front end and partially also at its sides, whereupon the pressure of the material exerted from above must be reduced to a minimum load by methodically shifting away the material and removing the shifted material. Frequently, the consolidating trestle can only be pulled out by external assistance, for example by using bucket wheel loaders or cutting machines. If a retracted consolidating trestle becomes buried under collapsed material, saving of the trestle is particularly difficult, because the collapsed material also laterally enters the consolidating trestle, so that removal of the consolidating trestle is no more easily possible.

SUMMARY OF THE INVENTION

The invention now aims at providing a movable consolidating trestle of the initially mentioned type and to substantially facilitate saving of such a trestle also in the case that the consolidating trestle becomes buried under collapsed material. For solving this task, the consolidating trestle according to the invention is essentially characterized in that the cap is subdivided in transverse relation to its longitudinal direction into at least two sections, in that at least one section located at a front side of the cap is connected to the cap in a bent manner or a rounded manner and in that the bent section or, respectively, the tangential plane to the rounded front-side end of the section includes with that plane of the cap, which extends in parallel relation to the frame, an angle being greater than or equal to the maximum angle of inclination of the cap existing under the condition of completely retracted props below that section which is located opposite the bent or rounded section. On account of the cap being subdivided in transverse relation to its longitudinal direction into at least two sections, there can be obtained an inclined position or, respectively, an angled position of the surface facing the roof by lowering the cap at one side, so that the pressure exerted onto the cap can be minimized. With the pressure acting on the cap being correspondingly reduced, the consolidating trestle can more easily be saved by means of its own drive means provided by the endless chains or by means of additional machines. The bent or rounded arrangement of a front-side section of the cap has as the result that, when lowering the cap at one end , the front-side section can be maintained in a position, in which this section not further penetrates the roof when moving the consolidating trestle and still remains manueuverable, because the bent section or, respectively, the tangential plane to the rounded front-side end of the section includes with that plane of the cap, which extends in parallel relation of the frame, an angle being greater than or equal to the maximum angle of inclination of the cap under the condition that the props are completely retracted below that section which is located opposite the bent section or rounded section. In this manner, saving of a buried consolidating trestle can be substantially simplified and be made less time-consuming and be started immediately after a collapse of the roof. By lowering or retracting, respectively, both rear props facing the collapsed material, the cap can be inclined in rearward direction without running the risk that the front end of the cap penetrates the roof when moving the consolidating trestle in direction of the front end. On account of the cap assuming an inclined position, the horizontal force component of the force-exerting collapsed material acts in the saving direction, whereby manueuverability in the saving direction is improved and an additional protection against collapsing material entering below the cap is provided by lowering the cap.

In case of bigger plates of roof material resting on the cap, the possibility to swivel individual segments or the rounded arrangement itself can be utilized for shifting load-exerting material in rearward direction and crush such material during shifting. For this purpose, the arrangement is advantageously selected such that swivellable segments of the cap are swivellably connected to other segments of the cap and are supported via separate cylinder-piston-aggregates on the frame and/or on props connecting the frame with the cap. Such segments of the cap, which segments can be tilted in rearward direction and can be given an inclined position, provide the possibility to utilize in an optimum manner the horizontal component of the load-exerting forces for saving the buried consolidating trestle and to strip off load-exerting collapsed material. For facilitating the movability, a front-side cap and/or a front-side frame part can be designed like a plough, for preventing the consolidating trestle from digging itself.

If the drive means of the consolidating trestle is insufficient for moving same, there can, in an advantageous manner, be made the provision for connecting points for saving cylinders at one front side, noting that such an equipment is also suitable to save other equipment having become buried under collapsed material, if the anchor force of the applied cap is used for supporting the tension forces. It is of advantage to arrange the connecting points for the saving cylinders at least on that front side of the frame which carries the part being designed like a plough, so that the consolidating trestle having become buried under collapsed material can easier be saved with external assistance. As a whole, the consolidating trestle shall be designed such that it exerts as little resistance as possible against being pulled out and that it has no protruding parts protruding beyond the lateral sides or beyond the top surface of the cap. Such surfaces and caps being as smooth as possible as well as a plough-like part facilitate pulling out of the trestle, because the collapsed material can more easily be laterally displaced. For utilizing the forces of the roof material or, respectively, collapsed material resting on the cap, it must be possible to lower or, respectively, retract the cap at one side of the consolidating trestle as far as possible till near the frame so that a maximum inclined position of the cap becomes possible. The construction comprising a plurality of cap segments being connected one to the other in a swivellable manner provides the possibility to obtain a sufficiently inclined position of at least parts of the cap also in case of a restricted retractability of the props and thus to make better use of a horizontal force component of the load exerting rock.

BRIEF DESCRIPTION OF THE DRAWINGS

In the following, the invention is explained in greater detail with reference to embodiments shown in the drawing, in which.

DESCRIPTION OF THE PREFERRED EMBODIMENTS

Figure 1:
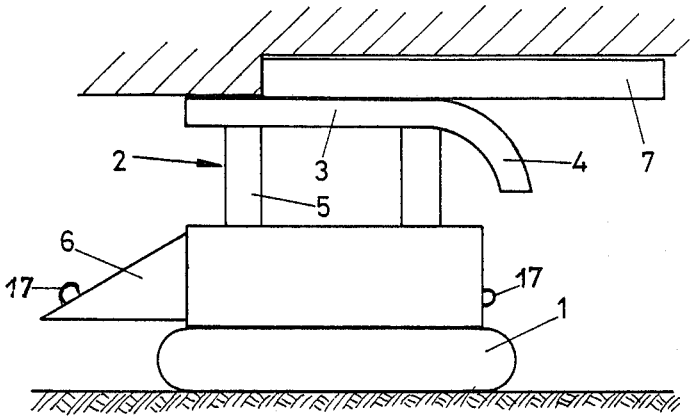
FIG. 1 shows a schematic side elevation of a consolidating trestle comprising a rounded cap.
Figure 2:
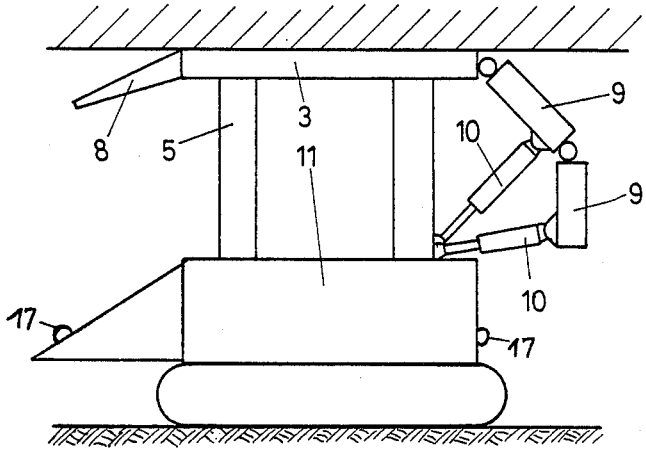
FIG. 2 shows an embodiment comprising swivellable cap parts being swivellably linked one to the other.

There is shown in FIG. 1 a consolidating trestle 2 having an endless tread chassis 1 with self-contained drive and having its cap 3 rounded in the rear section 4. The props of the consolidating trestle are designated by the reference numeral 5. The consolidating trestle has a plough-like frame part 6 at its front side. If, as is shown in FIG. 1, a roof plate 7 rests on such a cap 3, this plate 7 can, by moving the consolidating trestle 2 by its own drive means, be shifted for such a distance that it falls down in rearward direction, whereby the consolidating trestle is again cleared. In the embodiment according to FIG. 2, the cap 3 has a rigid bent front section 8 and swivellable segments 9, which are supported on the frame 11 of the consolidating trestle by means of cylinder-piston-aggregates 10. The props are again designated by the reference numeral 5.

Figure 3:
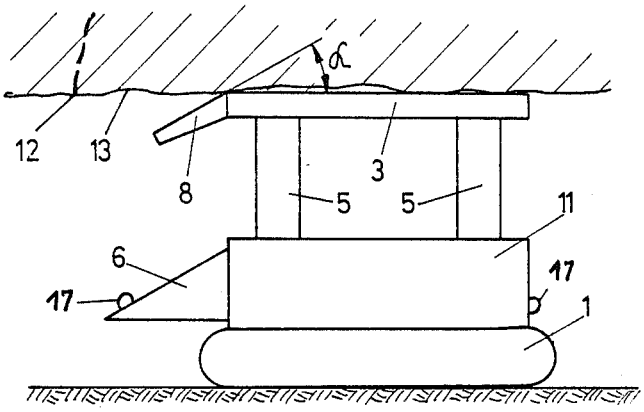
FIG. 3 shows a consolidation trestle located in proximity of an expected fracture edge and having the props expanded.
Figure 4:
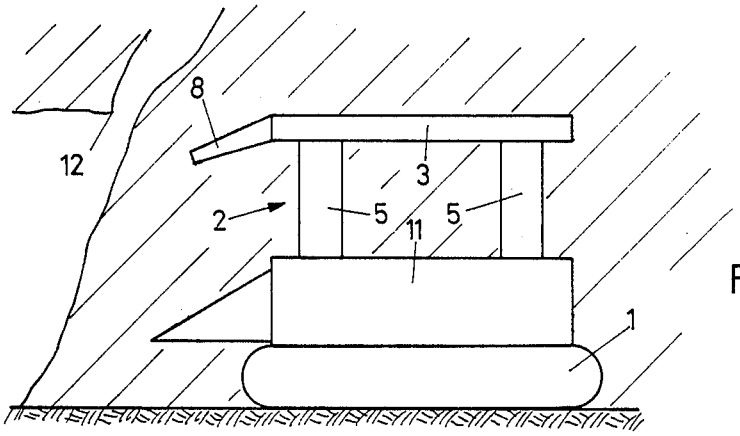
FIG. 4 shows a consolidating trestle corresponding to the representation according FIG. 3 and having become buried under collapsed material and FIG. 5 shows in a schematic representation the measures for saving such a consolidating trestle.
Figure 5:
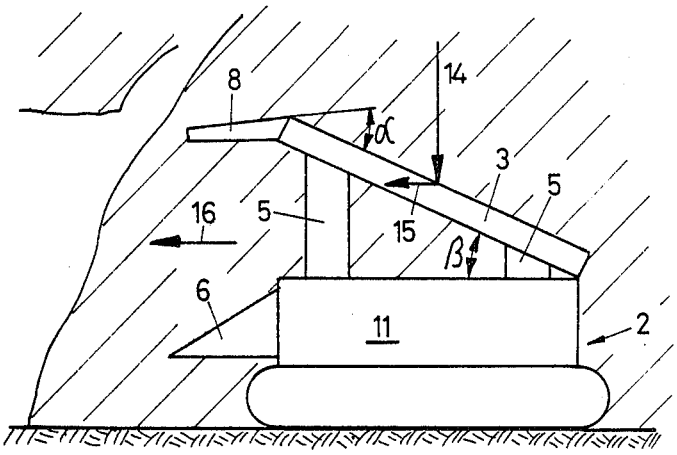

Removal of such a consolidating trestle in case of collapsing roof is explained in greater detail in the FIGS. 3, 4 and 5. The expected fracture edge on the roof 13 is designated by the reference numeral 12 in FIG. 3. The bent front section 8 of the cap 3 includes with the cap plane an angle $\alpha$ being greater than the maximum angle of inclination $\beta$ of the cap 3, shown in FIG. 5. The endless tread chassis is again designated by reference numeral 1, and props 5 are again schematically shown between the frame 11 and the cap 3.

If the roof becomes fractured at the fracture edge 12, as is shown in FIG. 4, the consolidating trestle 2 becomes buried under collapsed material, noting that the collapsed material may cover the whole consolidating trestle 2. FIG. 4 shows the consolidating trestle a short time after fracturing having taken place, noting that the props 5 are shown in still expanded condition. For saving such a consolidating trestle, the rearward props 5 are now, as is shown in FIG. 5, retracted, noting that the forward props remain substantially in their original expanded position. Thus, there results an angle $\beta$ of inclination of the cap 3, noting that a further pressure-relief can be obtained by retracting the front prop 5 for a short length. These procedures may, with he remote control and the current supply being intact, be performed under the collapsed material. Otherwise, the fractured material located in front of the front edge and thus in front of the plough-like part 6 of the frame 11 would have to be at least partially removed.

The force of the roof acts now onto the cap 3 in direction of the arrow 14 and there results on account of the inclined position of the cap 3 a horizontal component of this force, which component is indicated by the arrow 15. This force thus acts in saving direction and provides the possibility to pull the consolidating trestle 2 out of the collapsed material with reduced force. The front cap portion 8 including an angle $\alpha$ with the cap plane of the cap 3 remains, on account of the smaller angle $\beta$, in a position in which there exists no risk that the front tip of the front cap part 8 penetrates the collapsed material when moving the consolidating trestle in direction of the arrow 16 and this front cap part 8 forms a roof-like guiding surface acting advantageously like a plough when pulling the consolidating trestle 2 out of the collapsed material.

Connecting points 17 for saving cylinders are indicated at the respective front sides of the consolidating trestle 2.

What is claimed is:

1. A movable consolidating trestle for securing fracture edges in a mine roof comprising: an endless-tread drive and a rigid frame carried by said drive; a roof-supporting planar cap located above said frame, said cap having a longitudinal dimension, a forward end portion and a rear end portion; at least four vertically extendable and retractable props having lower ends carried by said frame and having upper ends supporting said cap, said props being arranged under said forward and rear end portions of said cap such that said rear end portion can be lowered relative to said forward end portion whereupon said cap becomes inclined upwardly and forwardly relative to said frame, whereby in a lowered position of said rear end portion, in the event that the trestle becomes buried in fallen mine-roof material, the vertically downward force of the material on said cap results in a horizontal component of force on said cap in the forward direction, said forward end portion of said cap including a front section which has an upper surface extending downwardly and forwardly relative to the plane of said cap, the relationship of said downwardly and forwardly extending section to the plane of said cap being such that, when said rear end portion of said cap has been lowered, said upper surface of said front extension extends downwardly and forwardly relative to the vertical downward force of mine-roof material when the trestle is buried in such material.

2. A movable consolidating trestle for securing fracture edges in a mine roof comprising: an endless tread-drive and a rigid frame carried by said drive; a roof-supporting planar cap located above said frame, said cap having a longitudinal dimension, a first end portion and an opposite, second end portion; at least four vertically extendable and retractable props having lower ends carried by said frame and having upper ends supporting said cap, said props being arranged under said end portions of said cap such that said second end portion can be lowered to a predetermined position relative to said first end portion by substantially complete retraction of the props under said second end portion, the plane of said cap forming an angle $\beta$ with a horizontal plane when said cap is in said predetermined position, said first end portion of said cap terminating in a section having a planar upper surface which extends in a first direction downwardly and away from said second end portion, said upper surface forming an angle $\alpha$ with the plane of said cap which is greater than or equal to the angle $\beta$.

3. A movable consolidating trestle for securing fracture edges in a mine roof comprising: an endless tread-drive and a rigid frame carried by said drive; a roof-supporting planar cap located above said frame, said cap having a longitudinal dimension, a first end portion and an opposite, second end portion; at least four vertically extendable and retractable props having lower ends carried by said frame and having upper ends supporting said cap, said props being arranged under said end portions of said cap such that said second end portion can be lowered to a predetermined position relative to said first end portion by substantially complete retraction of the props under said second end portion, the plane of said cap forming an angle $\beta$ with a horizontal plane when said cap is in said predetermined position, said first end portion of said cap terminating in a section having an upper surface which is curved downwardly, the plane tangent to said upper surface forming with a horizontal plane an angle $\alpha$ which is greater than or equal to the angle $\beta$.

4. A trestle as in any one of claims 1, 2 or 3 wherein said section of said first end portion of said cap is formed of segments pivoted to each other, the segments being supported by respective piston-and-cylinder units connected between the segments and said frame.

5. A trestle as in any one of claims 1, 2 or 3 wherein said section of said first end portion of said cap is formed of segments pivoted to each other, the segments being supported by respective piston-and-cylinder units connected between the segments and adjacent props.

6. A trestle as in any one of claims 1, 2 and 3 wherein said frame has a plow-shaped end remote from that end portion of said cap which can be lowered.

7. A trestle as in any one of claims 1, 2 or 3 wherein said downwardly extending end section of said cap is plow shaped.

8. A trestle as in any one of claims 1, 2 or 3 including means carried by said frame for connecting to a remotely-located piston-and-cylinder unit.

9. A trestle as in claim 6 including means carried by said plow-shaped end of said frame for connecting to a remotely-located piston and cylinder unit.

* * * * *